US006836217B2

(12) United States Patent
Andreas

(10) Patent No.: US 6,836,217 B2
(45) Date of Patent: Dec. 28, 2004

(54) CARBON DIOXIDE FIRE EXTINGUISHING DEVICE

(75) Inventor: Thomas Andreas, Temmels (DE)

(73) Assignee: Luxembourg Patent Company S.A., Lintgen (LU)

( * ) Notice: Subject to any disclaimer, the term of this patent is extended or adjusted under 35 U.S.C. 154(b) by 112 days.

(21) Appl. No.: 10/352,854

(22) Filed: Jan. 29, 2003

(65) Prior Publication Data

US 2004/0164868 A1 Aug. 26, 2004

Related U.S. Application Data

(63) Continuation of application No. PCT/EP01/09269, filed on Aug. 10, 2001.

(30) Foreign Application Priority Data

Aug. 10, 2000 (LU) ..... 90629

(51) Int. Cl.[7] ..... G08B 21/00

(52) U.S. Cl. ..... 340/605; 340/635; 340/626; 73/304 C; 73/49.2; 169/61; 169/23; 137/557

(58) Field of Search ..... 340/632, 605, 340/614, 620, 626, 603; 73/304 C, 49.2; 169/61, 60, 23; 137/557–559, 551

(56) References Cited

U.S. PATENT DOCUMENTS 3,735,376 A * 5/1973 Kermer et al. ..... 340/605
3,946,175 A * 3/1976 Sitabkhan ..... 200/83 L
4,705,082 A 11/1987 Fanshawe et al. ..... 141/4
5,518,032 A * 5/1996 Berke ..... 137/899.4
5,701,932 A 12/1997 Bourscheid et al. ..... 137/558
6,131,667 A * 10/2000 Jesadanont et al. ..... 169/89

FOREIGN PATENT DOCUMENTS

| | | |
|---|---|---|
| EP | 0 670 452 | 9/1995 |
| GB | 2 084 014 | 4/1982 |
| GB | 2 315 335 | 1/1998 |
| WO | WO 81/02484 | 9/1981 |

* cited by examiner

*Primary Examiner*—Daniel Wu
*Assistant Examiner*—Sihong Huang
(74) *Attorney, Agent, or Firm*—Gary M. Nath; Gregory B. Kang; Nath & Associates

(57) ABSTRACT

The invention relates to a carbon dioxide fire extinguishing device comprising a capacitive measuring device (11) which is calibrated for a temperature range above and below the critical temperature of carbon dioxide and which is used to detect the amount of gas loss from a carbon dioxide pressure tank (10). The carbon dioxide fire extinguishing device comprises an outlet valve in which the capacitive measuring probe (12) is integrated in such an advantageous way that the outflow resistance of the extinguishing gas is hardly increased at all.

17 Claims, 4 Drawing Sheets

CARBON DIOXIDE FIRE EXTINGUISHING DEVICE

This application is a continuation of International Patent Application No. PCT/EP01/09269, having an International Filing Date of Aug. 10, 2001, the entire contents of which are hereby incorporated by reference in its entirety.

The present invention relates to a carbon dioxide fire extinguishing device.

PRIOR ART

For fire extinguishing devices with gaseous extinguishing media it is prescribed that the pressure vessel in which the extinguishing medium is stored under pressure is checked for gas losses. In the case of carbon dioxide pressure cylinders, it must be ensured that a gas loss of over 10% of the filling weight is reliably detected. In their periodic testing, transportable carbon dioxide fire extinguishers are weighed by means of a calibrated balance. As a result, a gas loss between two tests remains unnoticed. In the case of stationary carbon dioxide fire extinguishing systems, the carbon dioxide pressure cylinders hang individually in a weighing device, so that the weight of each individual carbon dioxide pressure cylinder is continuously monitored. If the weight falls below a fixed weight, an alarm is set off. Such weighing devices for suspending carbon dioxide pressure cylinders significantly increase the cost of stationary fire extinguishing devices. Moreover, they must be calibrated at regular intervals.

Until now, there has been no satisfactory alternative to the weighing of carbon dioxide pressure cylinders.

Pressure monitoring procedures are entirely unsuitable for detecting a gas loss from a carbon dioxide pressure cylinder, since, in the case of a customary filling ratio of 1:1.50 (i.e. a filling weight of 0.666 kg of carbon dioxide per liter of cylinder volume), below a temperature of 27° C. a gas loss of 10% no longer causes a significant drop in pressure in the cylinder (in the case of a filling ratio of 1:1.34, i.e. a filling weight of 0.746 kg of carbon dioxide per liter of cylinder volume, this lower temperature limit is even around 22° C.). Moreover, the pressure in the carbon dioxide pressure cylinder is highly temperature-dependent.

At least in the case of fire extinguishing devices, filling level gages with floats have also been unable to establish themselves as an alternative to the weighing of carbon dioxide pressure vessels. A valve with an integrated filling level gage with a float, as known for example for a carbon dioxide pressure cylinder from the U.S. Pat. No. 4,580,450, cannot be used in carbon dioxide fire extinguishing systems because the linkage of the filling level gage takes up considerable space in the valve base and this means that the inlet bore for the gas in the valve base has to be relatively small. It should be noted in this connection that carbon dioxide pressure cylinders for stationary carbon dioxide fire extinguishing devices have in the neck of the cylinder an internal thread of only W 28.8×1/14" according to DIN 477. It must be possible to screw into this internal thread a valve base which has a prescribed inlet bore for the extinguishing agent of at least 12 mm in diameter, in order that the carbon dioxide can flow into the valve with a low pressure loss after the fire extinguishing device is put into action.

The U.S. Pat. No. 5,701,932 discloses for gas cylinders with high-purity gases a gas cylinder valve with a built-in capacitive filling level measuring device as an alternative to a mechanical filling level measurement with a float. The capacitive filling level measurement described in U.S. Pat. No. 5,701,932 is based here on the principle that the liquid phase of a gas has a far higher dielectric constant than the gaseous phase, so that dropping of the liquid level in the pressure cylinder is reflected by a reduction in the capacitance of the probe. This measuring principle consequently presupposes that the measurement takes place at a given ambient temperature, at which it is ensured that there are two separate phases in the pressure cylinder, and that the level of the liquid in the pressure cylinder drops if gas is extracted from the pressure cylinder. However, by contrast with the application for high-purity gases described in U.S. Pat. No. 5,701,932, this is by no means always the case with a carbon dioxide pressure cylinder for fire extinguishing purposes. In fact, one application for fire extinguishing devices where carbon dioxide pressure cylinders are used is in machine rooms for protecting equipment, where it is quite possible for ambient temperatures of over 40° C. to be reached.

With a filling ratio of the carbon dioxide pressure cylinder of 1:1.50 (i.e. 0.666 kg of carbon dioxide per liter of cylinder volume), the liquid phase of the carbon dioxide then already takes up the entire volume of the cylinder when the temperature reaches 27.2° C., so that above this temperature a gas loss no longer necessarily brings about a change in the level of the liquid in the pressure cylinder. Moreover, the critical temperature of the carbon dioxide from which the carbon dioxide forms a supercritical fluid, because there is in any case no longer any difference between a gaseous phase and a liquid phase, is as low as 31° C.

Furthermore, it should be noted with respect to the valve with the filling level measuring device from U.S. Pat. No. 5,701,932 that it is also not suitable for flow-related reasons for carbon dioxide pressure cylinders in fire extinguishing devices. In fact, in a valve base with a screw-in thread of W 28.8×1/14", the fitting of the capacitive measuring probe takes up so much space that there is no space left for an inlet bore of at least 12 mm in diameter for the carbon dioxide extinguishing gas. To obtain enough space for such a 12 mm inlet bore in the valve base, the diameter of the capacitive measuring probe could of course be made even smaller. However, for this it would be necessary to accept stability problems with respect to the measuring probe, which cannot be tolerated in the case of an element with relevance to safety.

OBJECT OF THE INVENTION

The present invention is accordingly based on the object of reliably checking the carbon dioxide pressure vessel in a carbon dioxide fire extinguishing device for gas losses without weighing, at both low and high ambient temperatures. This object is achieved according to the invention by a device as claimed in claim 1.

GENERAL DESCRIPTION OF THE INVENTION

In a carbon dioxide fire extinguishing device according to the invention, a capacitive measuring device which is calibrated for a temperature range above and below the critical temperature of the carbon dioxide is used for detecting a gas loss from the carbon dioxide pressure vessel. In other words, the present invention is based on the surprising realization that a capacitive measuring device can not only measure changes in the liquid level in the pressure vessel in a known way but a measurable change in capacitance can also be unequivocally assigned to a gas loss from the pressure vessel even above the critical temperature of the carbon dioxide, i.e. when there is no longer any physical difference between the gaseous phase and the liquid phase of the carbon dioxide.

In this way, a simple solution is provided for detecting a gas loss from a carbon dioxide pressure vessel of a fire extinguishing device which can even be used at high ambient temperatures (i.e. temperatures above 30° C.) and makes laborious weighing of the pressure vessel superfluous.

Such a capacitive measuring device preferably comprises a capacitive measuring probe which extends over the entire height of the pressure vessel, a measuring module for measuring the capacitance of the capacitive measuring probe, a microprocessor for processing the measured capacitance values, which assigns to a measured change in capacitance a corresponding gas loss, and also means for generating an alarm message if the gas loss determined by the microprocessor exceeds a given value.

The calibration preferably takes place electronically, using for example a temperature sensor and a memory with calibration values for a temperature range above and below the critical temperature of the carbon dioxide. The microprocessor resorts temperature-dependently to the calibration values in the memory in order to assign to a measured change in capacitance a corresponding gas loss. If the calculated gas loss exceeds a given value, the microprocessor generates an alarm message.

Such a device is outstandingly suitable for checking the gas content of carbon dioxide pressure cylinders, both at high ambient temperatures and at low ambient temperatures. It is accordingly particularly suitable for use in carbon dioxide fire extinguishing devices, in which the ambient temperature may lie between −20° C. and +60° C.

In order that this device can also be used unproblematically in a carbon dioxide fire extinguishing device in combination with a carbon dioxide pressure cylinder, the present invention has additionally solved the problem of introducing the capacitive measuring probe into the carbon dioxide pressure cylinder through the narrow cylinder neck in such an advantageous way that the outflow resistance of the extinguishing gas from the pressure cylinder is hardly increased at all. For this purpose, the present invention has provided an outlet valve for a carbon dioxide pressure cylinder with an integrated capacitive measuring probe, a first measuring electrode being formed by a rising tube which opens into the valve base and a second measuring electrode being formed by an electrode tube which surrounds the rising tube, with an intermediate gap, over its entire length. This outlet valve has the end effect of providing a simple, reliable and low-cost possible way of checking transportable carbon dioxide fire extinguishers for gas loss more easily and more frequently, and of avoiding complex weighing devices for carbon dioxide pressure cylinders in stationary carbon dioxide fire extinguishing devices. It must be emphasized in particular that such an outlet valve with a measuring probe may have approximately the same outflow resistance as a flow-optimized outlet valve without a measuring probe. At the same time, the capacitive measuring probe, in the case of which the rising tube forms an internal measuring electrode, is distinguished by excellent stability even in the case of large pressure cylinders. Forms of this valve in which the electrical connection to the capacitive measuring probe is solved in a particularly space-saving and trouble-free way are likewise presented.

In the case of a first configuration, an insulating sleeve surrounds the first end of the rising tube in the inlet bore of the valve base and insulates it electrically from the conducting valve base. In the inlet bore of the valve base, this first end of the rising tube is then in electrical contact with a contact element which is electrically insulated from the conducting valve base. The outer electrode tube, on the other hand, is electrically in contact with the conducting valve base and is electrically connected via the latter. The first end of the rising tube advantageously has an annular end face as a contact face for the insulated contact element, so that, to establish a reliable electrical connection between the insulated contact element and the rising tube, the latter merely has to be pressed in the axial direction onto the contact element in the inlet bore of the valve base.

An insulated contact element suitable for this first configuration advantageously comprises a contact ring with approximately the same inside diameter and outside diameter as the annular contact area of the rising tube, and also an insulating ring with a larger outside diameter than the contact ring. This insulating ring rests with one end face against a shoulder face in the inlet bore and has in the other end face a recess into which the contact ring is made to fit. In the case of this configuration, a trouble-free contact of a large surface area is ensured between the rising tube and the contact element, at the same time reliably preventing an electrical short-circuit.

In the case of this first configuration, the valve base advantageously has a connecting channel, which forms an opening in the aforementioned shoulder face, on which the insulating ring rests in the inlet bore. The insulating ring then has for its part an annular groove in the end face, which rests on this shoulder face, the opening of the channel in the shoulder face opening into this annular groove, and a through-bore of the insulating ring extending from the annular groove to the contact ring. In the case of this configuration, an insulated connecting wire is then firmly connected by one end to the contact ring and inserted through the through-bore and the annular groove of the insulating ring into the connecting channel. The annular groove thereby prevents the connecting wire from being sheared off if the contact element is twisted in the inlet bore.

The second end of the aforementioned connecting wire is firmly connected to an externally accessible connecting element, the latter being fitted in a sealed and electrically insulated manner into a bore of the valve base. The conducting valve base establishes an electrical contact with the outer electrode tube. The electrical contact between the outer electrode tube and the valve base can then be established via an annular end face of the outer electrode tube, which is pressed against an annular end face of the valve base.

In the case of this first configuration, one end of the insulating sleeve preferably protrudes out of the bore of the valve base and serves for fastening the outer electrode tube. In an advantageous configuration, this electrode tube is, for example, screwed onto this end of the insulating sleeve in such a way that its annular end face is pressed firmly against the annular end face of the valve base. The insulating sleeve consequently thereby performs the function of an electrical insulator between the rising tube and the valve base, of an insulating spacer between the rising tube and the outer electrode tube and of a fastening and pressing device for the outer electrode tube. As a result of this multi-functional sleeve, a minimum of individual parts are required for the fitting of the two measuring electrodes. The insulating sleeve may, furthermore, have an electrically conducting outer wall, via which the valve base and the outer electrode tube are electrically connected to each other. As a result, the electrical contact between the valve base and the outer electrode tube is further improved.

In an alternative configuration of the measuring electrode, the rising tube is screwed by its upper end into the inlet bore of the valve base. An upper insulating sleeve is pushed onto the upper end of the rising tube. A lower fastening sleeve is screwed onto the lower end of the rising tube, the screwed-on fastening sleeve pressing the outer electrode tube axially against the upper insulating sleeve. The upper insulating sleeve is thereby advantageously pressed against an end face of the valve base. A preferred configuration of the lower fastening sleeve comprises a metallic core body, which is screwed onto the lower end of the rising tube, and an insulator, which is arranged between the metallic core body and the outer electrode tube.

DESCRIPTION ON THE BASIS OF THE FIGURES

An embodiment of the invention is now described on the basis of the accompanying figures, in which.

Figure 1:
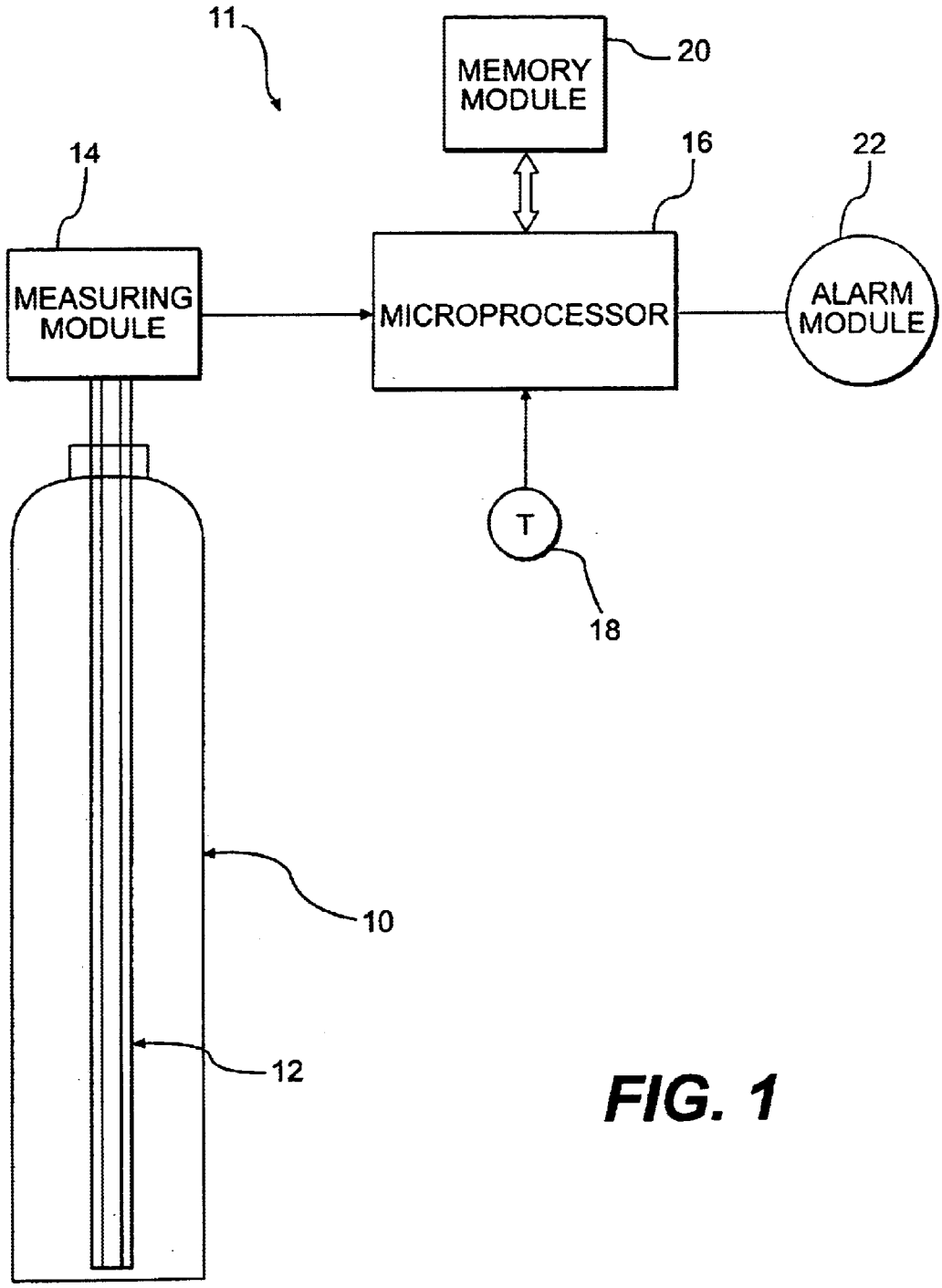
FIG. 1 shows a block diagram which an exemplary construction of a carbon dioxide fire extinguishing device according to the invention.

In FIG. 1, the reference numeral 10 designates a carbon dioxide pressure cylinder of a carbon dioxide fire extinguishing device. This carbon dioxide pressure cylinder is filled with carbon dioxide, for example with a filling ratio of 1:1.50, which corresponds to a filling weight of 0.666 kg of carbon dioxide per liter of cylinder volume. At a temperature of −20° C., 62.8% of the pressure cylinder 10 is filled with liquid carbon dioxide. At a temperature of +20° C., the proportion by volume of the liquid phase is 82%. At a temperature of 27.2 ° C., finally, 100% of the pressure cylinder is filled with liquid carbon dioxide. From a temperature of 31° C. (=critical temperature of the carbon dioxide), there is no longer any physical difference between liquid carbon dioxide and gaseous carbon dioxide, i.e. there is also no longer any transition between a gaseous phase and liquid phase of the carbon dioxide. It remains to be noted that the pressure in the pressure cylinder rises from 19 bar at −20° C. to 170 bar at +60° C.

In FIG. 1, the carbon dioxide pressure cylinder 10 is equipped with a device according to the invention for detecting a gas loss from the pressure cylinder 10 which is designated overall by the reference numeral 11. This device comprises a capacitive measuring probe 12, which is made up of two electrodes. The latter extend over the entire height of the pressure cylinder 10 and are separated from each other by an intermediate gap, in which the carbon dioxide forms a dielectric. It should be noted that: (1) at temperatures below 27.2° C., the dielectric in the upper part of the intermediate gap is formed by gaseous carbon dioxide (at 20° C., for example, 82% of the measuring probe 12 is immersed in liquid carbon dioxide, while the remaining 18% is surrounded by gaseous carbon dioxide); (2) at temperatures between 27.2° C. and 31° C., the dielectric in the entire intermediate gap is formed by liquid carbon dioxide; and (3) at temperatures above 31° C., the dielectric in the entire intermediate gap is formed by supercritical carbon dioxide.

The functional principle of the device 11 is based on the surprising realization that a capacitive measuring device can not only measure changes in the liquid level in the pressure vessel 10 in a known way but a measurable change in capacitance of the measuring probe 12 can also be unequivocally assigned to a gas loss of several percent from the pressure vessel 10 even in the case where:

a) 100% of the pressure vessel 10 is filled with liquid carbon dioxide, and consequently a gas loss of several percent no longer necessarily brings about a change in the liquid level in the pressure cylinder; and
b) the critical temperature of the carbon dioxide (31° C.) is exceeded, and the carbon dioxide consequently forms a supercritical fluid, in that there is no longer any difference between a gaseous phase and a liquid phase.

This functional principle of the device 11 is preferably implemented as follows. The capacitive measuring probe 12 is connected to a measuring module 14, which measures the capacitance of the capacitive measuring probe 12 and passes on its measured values to a microprocessor 16. In a memory module 20, to which the microprocessor 16 has access, calibration values for a temperature range above and below the critical temperature of the carbon dioxide are stored. The ambient temperature is sensed by means of a temperature probe 18. The microprocessor 16 calculates on the basis of the measured temperature and the calibration value for this temperature the carbon dioxide content of the pressure cylinder 10 and compares this calculated carbon dioxide content with the desired content of the pressure cylinder. If a gas loss which exceeds a given value is detected, the microprocessor 16 generates an alarm message, which is indicated for example by means of an optical and/or acoustic alarm module 22. In this way, a simple device which can also be used at high ambient temperatures is provided for detecting a gas loss from a carbon dioxide pressure vessel.

Figure 2:
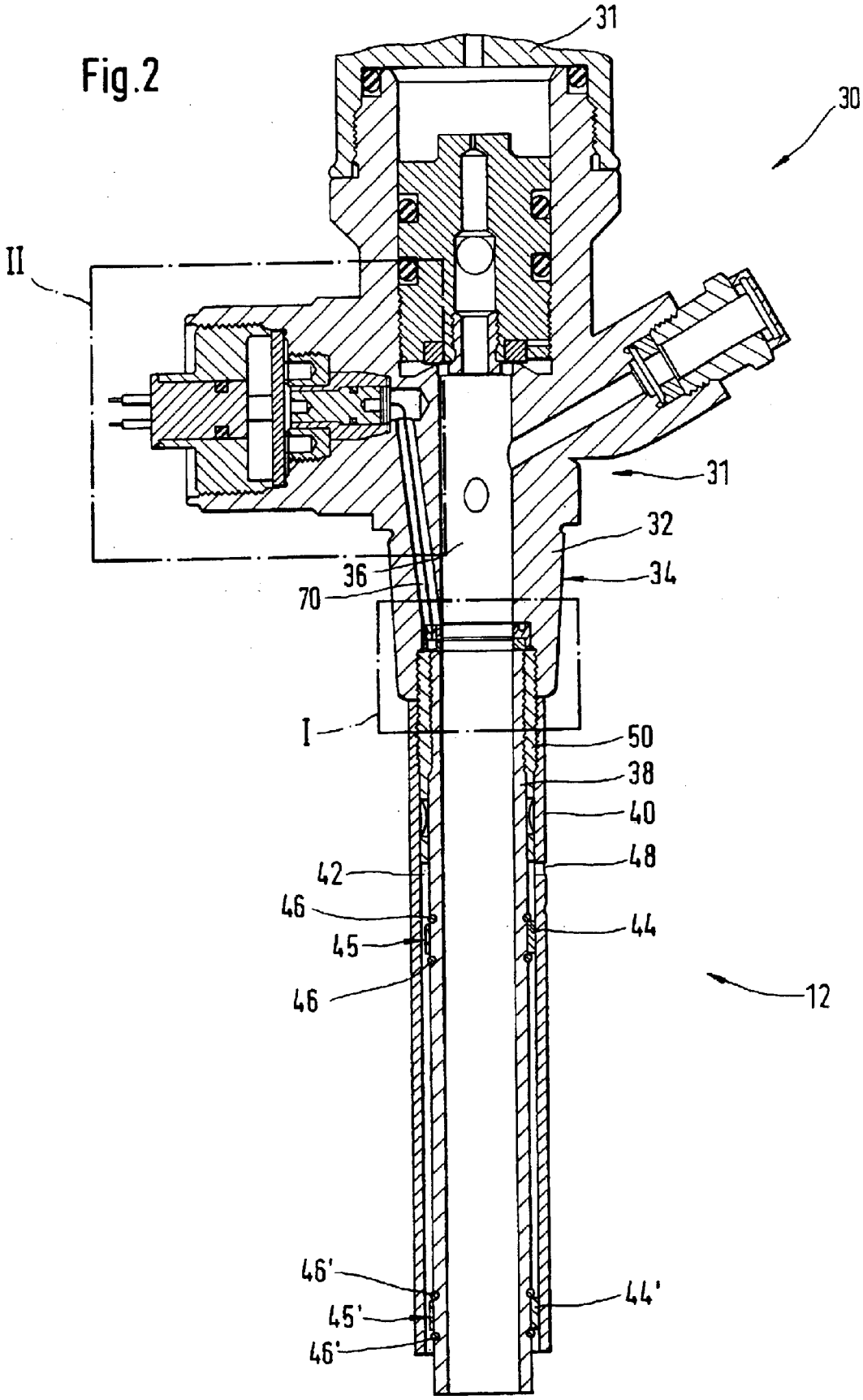
FIG. 2 shows a longitudinal section through an outlet valve of a carbon dioxide fire extinguishing device with an integrated device for detecting a gas loss from the connected carbon dioxide pressure cylinder, a first embodiment of a rising tube which is formed as a capacitive measuring probe being shown.

FIG. 2 shows an outlet valve 30 of a stationary carbon dioxide fire extinguishing device, into which a capacitive measuring probe 12 is integrated. The upper part 31 of the outlet valve 30, which comprises a triggering device, is only indicated in FIG. 2, since it is not significant for understanding the present invention.

The outlet valve 30 comprises a valve body 31 with a valve base 32 with an external thread 34, by which it is screwed into the valve neck of a carbon dioxide pressure cylinder. It should be noted in this respect that the carbon dioxide pressure cylinders which are used in stationary fire extinguishing devices have in their cylinder neck a thread of merely W 28.8×1/14" according to DIN 477 for screwing in the valve base 32, i.e. there is relatively little space in the valve base 32.

Arranged inside the valve base 32 is an inlet bore 36, into which a rising tube 38 opens axially. This rising tube 38 extends almost right up to the cylinder base. It should be noted that, in a stationary carbon dioxide fire extinguishing device, the inlet bore 36 in the valve base 32 and the rising tube 38 must have at least an inside diameter of 12 mm in order to ensure that, after the fire extinguishing device is set off, the extinguishing gas can flow via the rising tube 38 into the outlet valve 30 with adequately low pressure loss.

The capacitive measuring probe 12 is formed in the outlet valve 30 of FIG. 2 by the rising tube 38 and by an outer electrode tube 40, which surrounds the rising tube 38 with an intermediate gap 42. In other words, the capacitive measuring probe 12 comprises two coaxial tubular electrodes, the rising tube 38 forming the inner electrode, the electrode tube 40 forming the outer electrode. The annular intermediate gap 42 between the two electrodes 38 and 40 is taken up by liquid, gaseous or supercritical carbon dioxide, which forms a dielectric between the two electrodes 38 and 40.

Annular spacers 44, 44' of an insulating material, the wall thickness of which corresponds to the width of the intermediate gap 42, are respectively fastened to the rising tube 38 by means of a pair of securing rings 46, 46' and ensure that the annular intermediate gap 42 between the two electrodes remains constant over the entire length of the measuring probe 12. It should be noted that the spacers 44, 44' have local flattened portions 45, 45', so that the carbon dioxide can flow along the spacers 44, 44' into the intermediate gap 42. The reference numeral 48 designates a venting opening at the upper end of the outer electrode tube 40, which ensures that the liquid level and the pressure in the intermediate gap 42 and the pressure cylinder always coincide.

Figure 3:
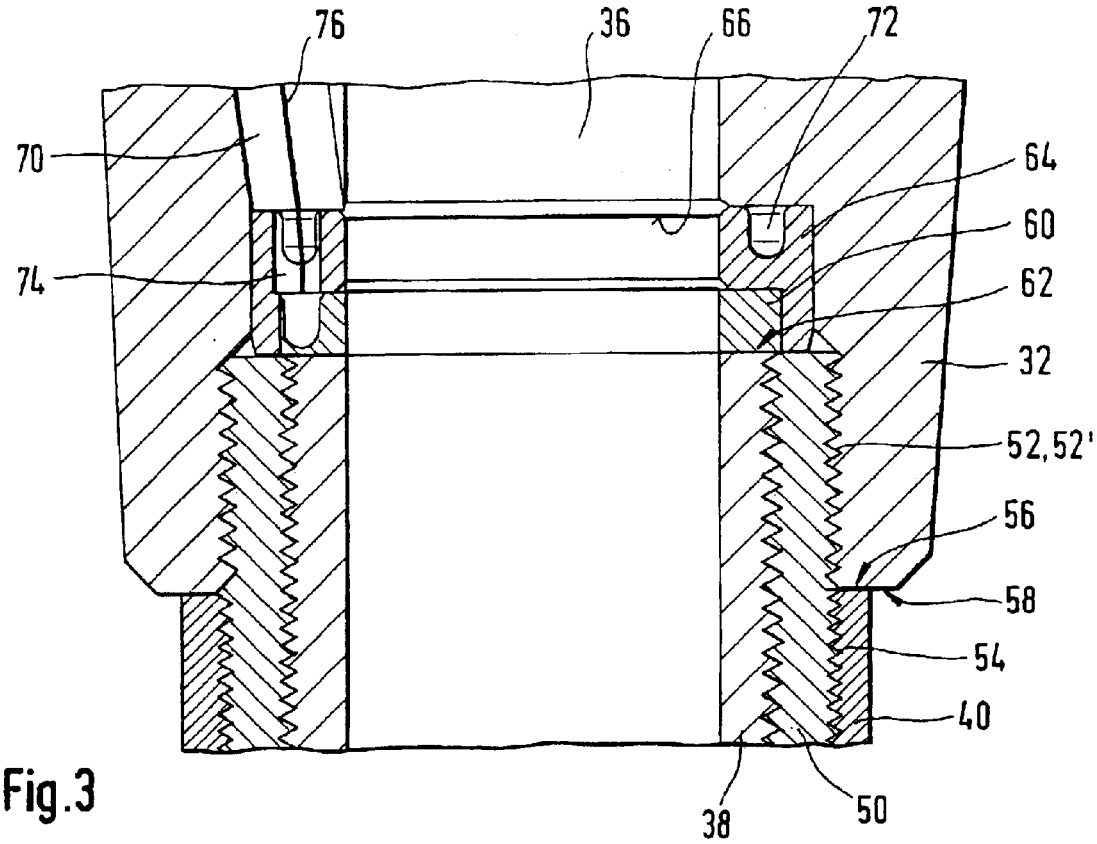
FIG. 3 shows an enlargement of the framed detail I from FIG. 2.

The fitting of the measuring probe 12 into the valve base 32 is now described in more detail on the basis of FIG. 3. An insulating sleeve 50 is screwed onto the upper end of the rising tube 38. This insulating sleeve 50 comprises at its upper end a first external thread 52, by which it is screwed into an internal thread 52' in a bore of the valve base 32. The lower end of the insulating sleeve 50 protrudes out of the bore of the valve base 32 and is provided with a second external thread 54. The upper end of the outer electrode tube 40 is screwed onto this second external thread 54 in such a way that it is pressed firmly by its end face 56 against an end face 58 of the electrically conducting valve base 32 and is consequently in electrical contact with the latter.

It should be emphasized that the insulating sleeve 50 consequently performs the function of an electrical insulator between the rising tube 38 and the valve base 32, of an insulating spacer between the rising tube 38 and the outer electrode tube 40 and of a fastening and pressing device for the outer electrode tube 40. As a result of this multifunctional sleeve, a minimum of individual parts are required for the fitting of the two measuring electrodes 38, 40. It should further be noted that the insulating sleeve 50 may likewise have an electrically conducting outer wall, via which the valve base 32 and the outer electrode tube 40 are electrically connected to each other. As a result, the electrical contact between the valve base 32 and the outer electrode tube 40 is improved still further.

Reference numeral 60 designates a contact ring, which has approximately the same inside diameter and outside diameter as the end face 62 of the rising tube 38. This contact ring 60 is made to fit into a recess in a first end face of an insulating ring 64. The latter has the same inside diameter as the contact ring 60, but a larger outside diameter, and rests with its second end face on a shoulder face 66 in the inlet bore 36. By screwing the rising tube 38 into the valve base 32 by means of the insulating sleeve 50, the end face of the rising tube 38 is pressed firmly against the contact ring 60, so that a reliable electrical connection is established between the rising tube 38 and the contact ring 60. To sum up, it consequently remains to be stated that the rising tube 38 in the inlet bore 36 of the valve base 32 is in contact with the contact ring 60 over a large surface area, the contact ring 60 being reliably insulated from the conducting valve base 32 by the insulating ring 64.

The reference numeral 70 designates a connecting channel in the valve base 32, which channel forms an opening in the shoulder face 66 on which the insulating ring 64 rests in the inlet bore 36. The insulating ring 64 has an annular groove 72 in the end face, which rests on the shoulder face 66, the opening of the connecting channel 70 opening into this annular groove 72. A through-bore 74 of the insulating ring 64 extends from the annular groove 72 to the contact ring 60. An insulated connecting wire 76 is firmly connected by a first end to the contact ring 60 and inserted through the through-bore 74 and the annular groove 72 of the insulating ring 64 into the connecting channel 70. The annular groove 72 thereby prevents the connecting wire 76 from being sheared off if the contact ring 60 is twisted in the inlet bore 36.

Figure 4:
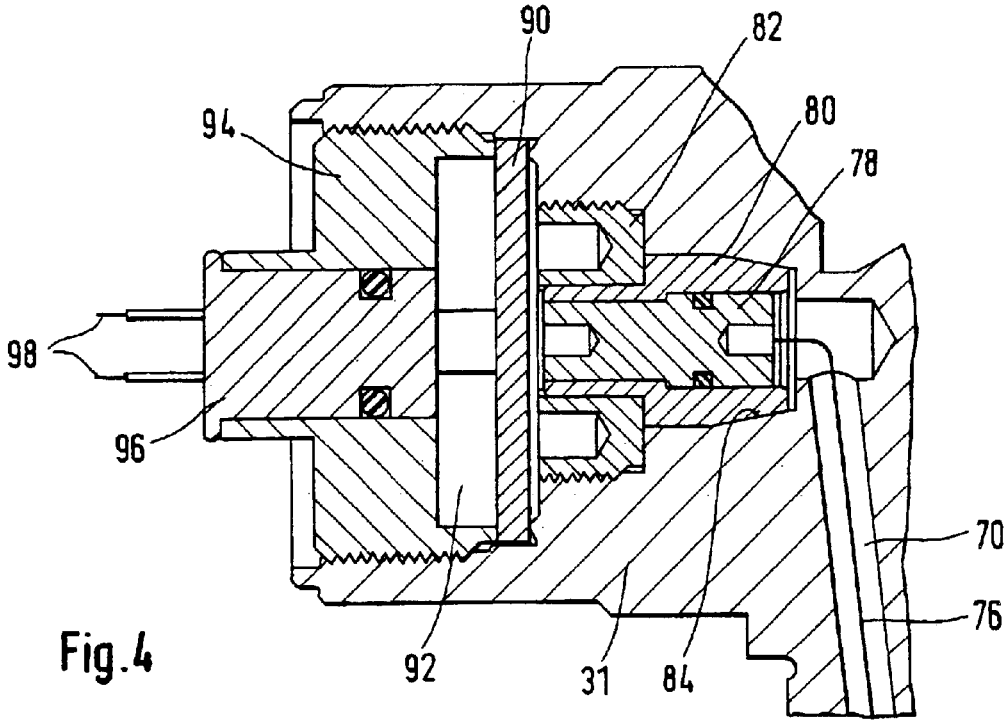
FIG. 4 shows an enlargement of the framed detail II from FIG. 2.

The description is now continued on the basis of FIG. 4. The connecting wire 76 is firmly connected to a rod-shaped connecting element 78. The latter is fitted in a sealed manner into a conical insulating sleeve 80, which for its part is pressed in a sealed manner by means of a clamping screw 82 into a conical bore 84 in the valve body.

The reference numeral 90 shows in FIG. 4 a printed circuit board with an electronic circuit, which is made to fit into a chamber 92 of the valve body. A screwed plug 94 closes the chamber 92 and at the same time fixes the printed circuit board 90 in the chamber 92. The printed circuit board 90 is connected by means of the connecting element 78 to the rising tube 38, which, as known, forms the first electrode of the capacitive measuring probe 12. The printed circuit board 90 is connected by means of the electrically conducting valve housing to the outer electrode tube 40, which, as known, forms the second electrode of the capacitive measuring probe 12. A plug 96, which is inserted in a sealed manner into a connecting socket in the screwed plug 94, makes it possible to connect the printed circuit board 90 to external circuits, or external power sources, by means of a connecting line 98.

Accommodated on the printed circuit board 90 are the measuring module 14, the microprocessor 16, the temperature probe 18 and the memory module 20. An alarm message is passed on via the connecting line 98 either to an external alarm module or to a central monitoring network.

Figure 5:
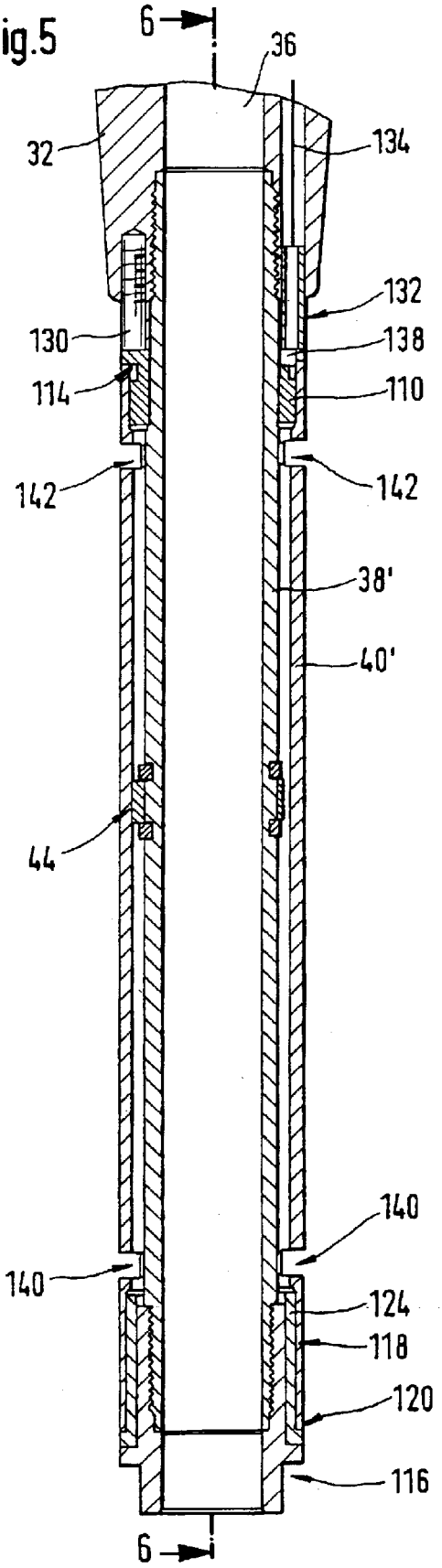
FIG. 5 shows a longitudinal section through a further embodiment of a rising tube which is formed as a capacitive measuring probe.
Figure 6:
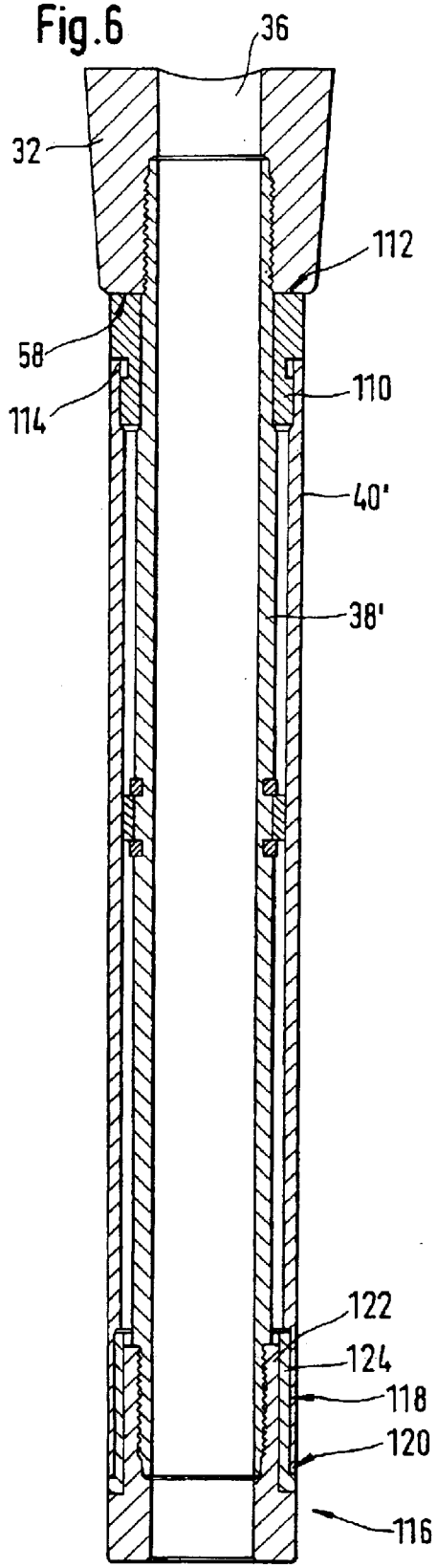
FIG. 6 shows a longitudinal section according to sectional line 6-6 through the rising tube of FIG. 5.

In the configuration according to FIGS. 5 and 6, the rising tube 38' is screwed by one end into the inlet bore 36 of the valve base 32, whereby the electrical contact between the valve base 32 and the rising tube 38' is established directly. The reference 110 designates an upper insulating sleeve, which is pushed onto the rising tube 38' and bears via an end face 112 against the end face 58 of the valve base 32. The outer electrode tube 40' is pushed by one end onto the lower end of the upper insulating sleeve 110 and bears with its upper end face against a shoulder face 114 of the upper insulating sleeve 110. Screwed onto the lower end of the rising tube 38' is a fastening sleeve 116. The latter has a cylindrical end 118, which is inserted into the lower end of the outer electrode tube 40'. When the fastening sleeve 116 is tightened, an annular pressing face 120 is supported on the lower end face of the electrode tube 40', in order to press the latter axially with its upper end face against the shoulder face 114 of the upper insulating sleeve 110, which for its part is pressed with its end face 112 against the end face 58 of the valve base 32.

The lower fastening sleeve 116 advantageously comprises a metallic core body 122, in which the internal thread for screwing onto the rising tube 38' is formed, and also an insulating sleeve 124, which is fitted onto the metallic core body 122 and avoids an electrical contact between the outer electrode tube 40 and the metallic core body 122. As an alternative to the insulating sleeve 124, the metallic core body 122 may also be coated with an insulating material. As a further alternative to the insulating sleeve 124, a fastening sleeve which is produced entirely from an insulating material may be used. However, the solution with a metallic core body 122 is distinguished by a greater mechanical strength under strong temperature fluctuations and is therefore preferred. As in the configuration of FIG. 2, at least one annular spacer 44 of an insulating material ensures that the annular intermediate gap 42 between the two tubes remains constant over the entire length.

The reference 130 in FIG. 5 designates an arresting pin which is screwed into a bore in the end face 58 of the valve base 32 and engages in a clearance in the upper insulating sleeve 110 in such a way that it blocks the latter against twisting. An arresting pin 132 with a through-bore is advantageously used as a cable lead-through. In this case, an insulated connecting cable 134 is inserted through a cable duct 136 in the valve base 32 through the arresting pin 132 with a through-bore into an outer clearance 138 in the insulating sleeve 110, where it is connected in an electrically conducting manner to the outer electrode tube 40'.

The reference numerals 140, 142 in FIG. 5 designate lateral openings in the lower and upper ends of the outer electrode tube 40'. These openings 140, 142 ensure that the intermediate gap 42 is in direct connection with the space inside the cylinder.

It remains to be noted that, although the present invention has been described only in connection with the detection of a gas loss from a carbon dioxide pressure vessel, it can of course also be applied to other gases which have properties similar to carbon dioxide.

What is claimed is:

1. A carbon dioxide fire extinguishing device comprising:

a carbon dioxide pressure cylinder for storing an extinguishing agent;

a device for detecting a gas loss from said carbon dioxide pressure cylinder;

wherein said device for detecting a gas loss from said carbon dioxide pressure cylinder comprises a capacitive measuring device which is calibrated for a temperature range below and above a critical temperature of said carbon dioxide.

2. The device as claimed in claim 1, wherein and said pressure cylinder has a height and said capacitive measuring device comprises:

a capacitive measuring probe, which extends over the entire height of said pressure vessel;

a measuring module for measuring said capacitance of said capacitive measuring probe;

a microprocessor, which assigns a gas loss value to a measured change in capacitance; and means for generating an alarm message if said gas loss value determined by said microprocessor exceeds a predetermined value.

3. The device as claimed in claim 2, wherein said capacitive measuring device further comprises:

a temperature sensor; and a memory module with calibration values for a temperature range below and above the critical temperature of said carbon dioxide, said microprocessor resorting temperature-dependently to said calibration values in order to assign a corresponding gas loss to a measured change in capacitance.

4. The device as claimed in claim 1, further comprising:

an outlet valve with a valve base for screwing onto a carbon dioxide pressure cylinder, said valve base having an inlet bore;

a rising tube having an upper end and a lower end, said upper end opening into said inlet bore of said valve base, so that, after opening of said outlet valve, said carbon dioxide gas flows via said rising tube into said outlet valve; and a capacitive measuring probe, which comprises two coaxial electrodes, said rising tube forming said first electrode, and said second electrode being formed by an outer electrode tube which surrounds said rising tube, with an intermediate gap.

5. The device as claimed in claim 4, further comprising:

an insulating sleeve, which surrounds said upper end of said rising tube in said inlet bore and electrically insulates it from said conducting valve base;

a contact element in said inlet bore of said valve base, which is electrically insulated from said conducting valve base and is electrically in contact with said upper end of said rising tube, wherein said outer electrode tube is electrically in contact with said conducting valve base.

6. The device as claimed in claim 5, wherein:

said rising tube has on its upper end an annular end face as a contact face for said insulated contact element.

7. The device as claimed in claim 6, wherein said insulated contact element comprises:

a contact ring with approximately the same inside diameter and outside diameter as said annular contact face of said rising tube; and an insulating ring with a larger outside diameter than said contact ring, said insulating ring having a first end face and a second end face, said first end face resting against a shoulder face in said inlet bore and said second end face having a recess into which said contact ring is made to fit.

8. The device as claimed in claim 7, further comprising:

a connecting channel in said valve base, which forms an opening in said shoulder face on which said insulating ring rests;

an annular groove in said first end face of said insulating ring, said opening of said connecting channel in said shoulder face opening into said annular groove;

a through-bore in said insulating ring from said annular groove to said contact ring; and an insulated connecting wire, which is firmly connected by a first end to said contact ring and inserted through said through-bore and said annular groove of said insulating ring into said connecting channel.

9. The device as claimed in claim 8, further comprising:

an externally accessible first connecting element, which is fitted in a sealed and electrically insulated manner into a bore of said valve base and to which said second end of said connecting wire is firmly connected.

10. The device as claimed 5, wherein said outer electrode tube has an annular end face, which is pressed against an annular end face of said valve base.

11. The device as claimed in claim 10, wherein:

said insulating sleeve has an end protruding out of said bore of said valve base, and said electrode tube is screwed onto said end of said insulating sleeve in such a way that its annular end face is pressed firmly against said annular end face of said valve base.

12. The device as claimed 11, wherein:

said insulating sleeve is screwed into said inlet bore.

13. The device as claimed in claim 10, wherein:

a first end of said insulating sleeve is screwed into said inlet bore;

a second end of said insulating sleeve protrudes out of said inlet bore;

said outer electrode tube is screwed onto said second end of said insulating sleeve; and said insulating sleeve has an electrically conducting outer wall, via which said valve base and said outer electrode tube are electrically connected to each other.

14. The device as claimed in claim 6, wherein said rising tube is screwed into said insulating sleeve.

15. The device as claimed in claim 5, wherein:

said rising tube is screwed with its upper end into said inlet bore of said valve base;

an upper insulating sleeve is pushed onto said upper end of said rising tube, a lower fastening sleeve is screwed onto said lower end of said rising tube, said screwed-on fastening sleeve pressing said outer electrode tube axially against said upper insulating sleeve.

16. The device as claimed in claim 15, wherein:

said upper insulating sleeve is pressed against an end face of said valve base.

17. The device as claimed in claim 15, wherein said lower fastening sleeve comprises:

a metallic core body, which is screwed onto said lower end of said rising tube; and an insulator, which is arranged between said metallic core body and said outer electrode tube.

* * * * *